US008887935B2

(12) United States Patent
Zemitis et al.

(10) Patent No.: US 8,887,935 B2
(45) Date of Patent: Nov. 18, 2014

(54) COLLAPSIBLE DURABLE OUTDOOR ADVENTURE CONTAINER

(75) Inventors: Martin Steven Zemitis, Lafayette, CA (US); Jonathan William Buck, Oakland, CA (US)

(73) Assignee: Slingfin, Inc., Berkeley, CA (US)

( * ) Notice: Subject to any disclaimer, the term of this patent is extended or adjusted under 35 U.S.C. 154(b) by 383 days.

(21) Appl. No.: 13/189,406

(22) Filed: Jul. 22, 2011

(65) Prior Publication Data

US 2012/0018427 A1 Jan. 26, 2012

Related U.S. Application Data

(60) Provisional application No. 61/366,911, filed on Jul. 22, 2010.

(51) Int. Cl.

| | |
|---|---|
| ***B65D 30/10*** | (2006.01) |
| ***A45C 7/00*** | (2006.01) |
| ***A45F 3/04*** | (2006.01) |
| ***A45C 3/00*** | (2006.01) |
| *A45F 3/08* | (2006.01) |

(52) U.S. Cl.

CPC ... *A45C 7/00* (2013.01); *A45F 3/04* (2013.01); *A45F 3/08* (2013.01); *A45C 3/001* (2013.01)

USPC ..... 220/9.3; 220/9.1; 383/4

(58) Field of Classification Search

USPC ..... 220/4.28, 9.1, 9.2, 9.3, 62, 4.33, 4.34; 383/4; 493/243

See application file for complete search history.

(56) References Cited

U.S. PATENT DOCUMENTS

| | | | | | |
|---|---|---|---|---|---|
| 191,712 | A | * | 6/1877 | Pickens | 229/109 |
| 268,542 | A | * | 12/1882 | Ruckert | 229/154 |
| 343,757 | A | * | 6/1886 | Cole | 229/198.1 |
| 648,182 | A | * | 4/1900 | Webb | 229/106 |
| 752,574 | A | * | 2/1904 | Moses | 229/125.22 |
| 1,404,528 | A | * | 1/1922 | Jeffs | 150/130 |
| 1,725,526 | A | * | 8/1929 | Kondolf | 229/125.22 |
| 1,871,101 | A | * | 8/1932 | Waltz | 135/119 |
| 2,483,789 | A | * | 10/1949 | Smith et al. | 4/506 |
| 3,188,027 | A | | 6/1965 | Sepp, Jr. | |
| 3,815,153 | A | * | 6/1974 | Vitol | 2/51 |
| 3,860,157 | A | * | 1/1975 | Richards et al. | 224/153 |
| 3,902,541 | A | * | 9/1975 | Wardwell | 383/72 |
| 3,948,528 | A | * | 4/1976 | Goodman et al. | 273/286 |
| 4,169,550 | A | * | 10/1979 | Williams | 224/633 |
| 4,509,645 | A | * | 4/1985 | Hotta | 206/545 |
| 4,817,824 | A | * | 4/1989 | LaFleur et al. | 222/105 |
| 4,871,597 | A | * | 10/1989 | Hobson | 428/36.1 |

(Continued)

FOREIGN PATENT DOCUMENTS

GB 544652 A 4/1942

*Primary Examiner* — Fenn Mathew
*Assistant Examiner* — Christopher McKinley

(57) ABSTRACT

A collapsible durable outdoor adventure container is constructed of polymer sheeting having holes in flaps of the sheeting. The sheet is bendable and bent by a user to a selected tubular configuration to align through holes along a seam line in flaps of the sheet or sheeting assembly with cable tie clamping elements clamping said flaps together through the holes. A strap coupled to at least several of the clamping element running along the seam line acting as an outside wrapping and/or tensioning element to contain the clamped flaps and fully or partially contain the contents of the container providing a connection tensioning element between adjacent clamping elements as connected along the seam line of the flaps.

16 Claims, 15 Drawing Sheets

(56) References Cited

U.S. PATENT DOCUMENTS

| | | | | | |
|---|---|---|---|---|---|
| 4,991,978 | A * | 2/1991 | Ostrowski | 383/4 |
| 5,092,681 | A * | 3/1992 | Ashley, III | 383/4 |
| 5,152,441 | A * | 10/1992 | Torena | 224/153 |
| 5,156,328 | A * | 10/1992 | Wozniacki | 229/125.22 |
| 5,195,828 | A * | 3/1993 | Bush-Rodriquez | 383/4 |
| 5,346,308 | A * | 9/1994 | Buhot et al. | 383/4 |
| 5,518,313 | A * | 5/1996 | McAdam | 383/4 |
| 5,577,730 | A * | 11/1996 | Vannozzi, Sr. | 273/260 |
| 5,765,748 | A * | 6/1998 | Chen | 229/125.22 |
| 5,857,778 | A * | 1/1999 | Ells | 383/5 |
| 5,934,527 | A * | 8/1999 | Von Neumann | 224/153 |
| 6,082,896 | A * | 7/2000 | Pulli | 383/6 |
| 6,193,118 | B1 * | 2/2001 | Kearl | 224/153 |
| 6,474,095 | B1 * | 11/2002 | Chan | 62/457.2 |
| 6,484,912 | B2 * | 11/2002 | Jones | 224/153 |
| 6,663,459 | B2 * | 12/2003 | Ostolaza | 446/75 |
| 6,948,203 | B2 * | 9/2005 | Tsai | 5/627 |
| 7,798,323 | B1 * | 9/2010 | McCann et al. | 206/370 |
| 8,118,201 | B1 * | 2/2012 | Calkin | 224/156 |
| 8,267,269 | B2 * | 9/2012 | Gundersen | 220/7 |
| 8,292,136 | B2 * | 10/2012 | Tonelli | 224/250 |
| 2003/0154931 | A1 * | 8/2003 | Ostrowiecki | 119/796 |
| 2004/0221392 | A1 * | 11/2004 | Tsai | 5/626 |
| 2005/0056643 | A1 * | 3/2005 | Hagan et al. | 220/9.3 |
| 2006/0124641 | A1 * | 6/2006 | Karow et al. | 220/62 |
| 2006/0124642 | A1 * | 6/2006 | Karow et al. | 220/62 |
| 2007/0000932 | A1 * | 1/2007 | Cron et al. | 220/592.24 |
| 2007/0062846 | A1 * | 3/2007 | Kim | 206/736 |
| 2008/0000914 | A1 * | 1/2008 | Frankenstein et al. | 220/507 |
| 2008/0237076 | A1 * | 10/2008 | Huang | 206/425 |
| 2008/0279483 | A1 * | 11/2008 | Yu | 383/6 |
| 2009/0080811 | A1 * | 3/2009 | Stefanek et al. | 383/61.3 |
| 2009/0145942 | A1 * | 6/2009 | Rice | 224/419 |
| 2010/0001004 | A1 * | 1/2010 | Slot | 220/495.08 |
| 2010/0008601 | A1 * | 1/2010 | Prudencio | 383/4 |
| 2010/0089915 | A1 * | 4/2010 | Fukuhara | 220/4.28 |
| 2010/0140263 | A1 * | 6/2010 | Claeys | 220/9.3 |
| 2010/0147918 | A1 * | 6/2010 | Hensley et al. | 224/600 |
| 2010/0316308 | A1 * | 12/2010 | Heinlen et al. | 383/25 |

* cited by examiner

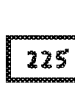
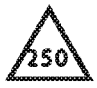
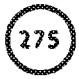
Figure 9
Figure 11
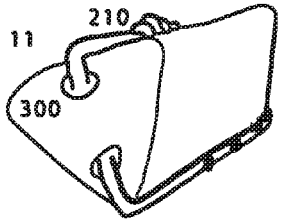
Figure 10
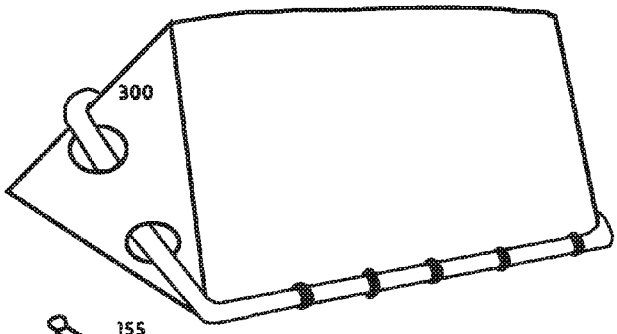
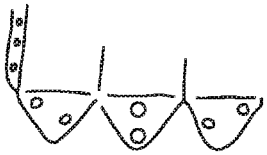
Figure 12A
Figure 13
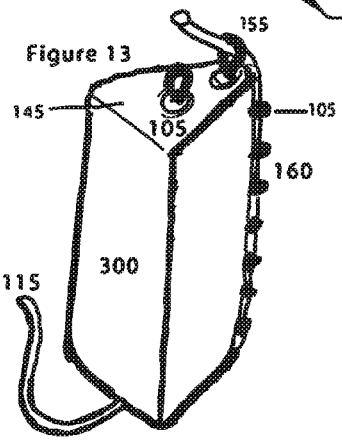
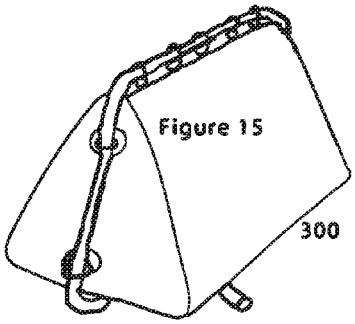
Figure 15
Figure 14
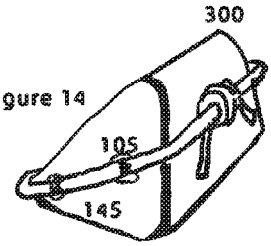
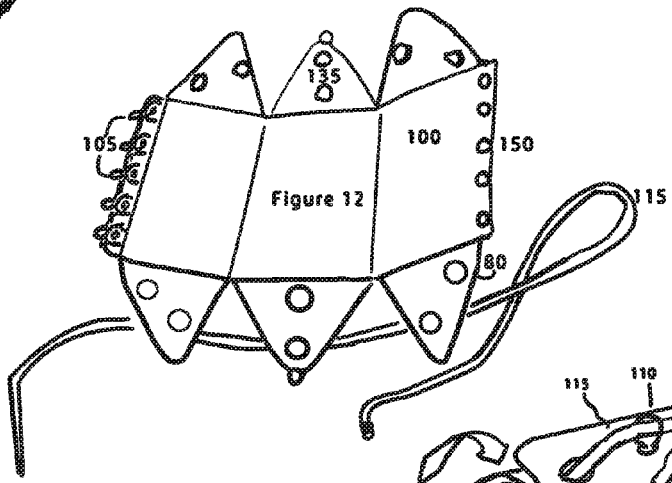
Figure 12
Figure 17
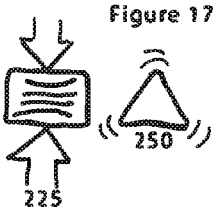
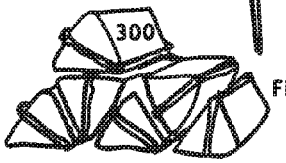
Figure 16
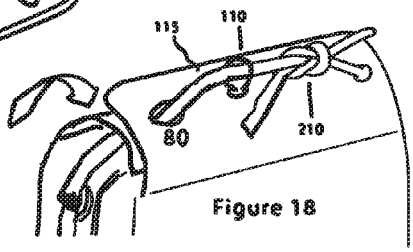
Figure 18

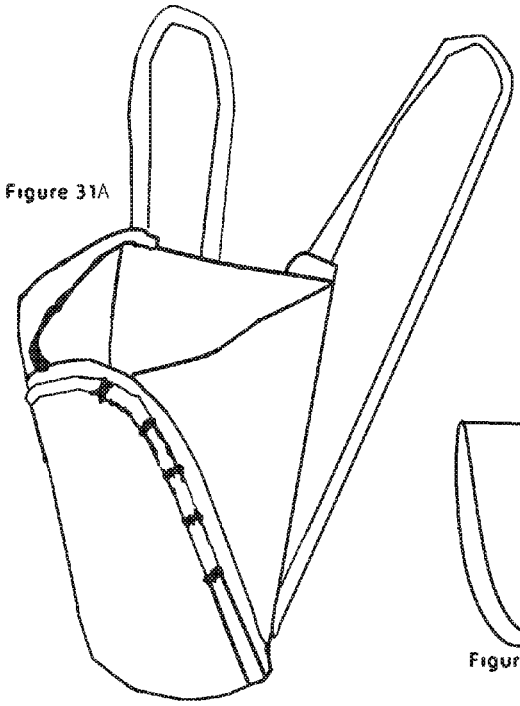
Figure 31A
Figure 32
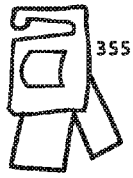
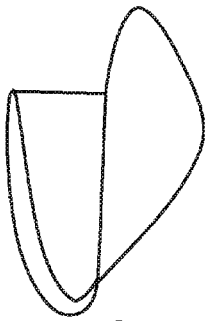
Figure 31B
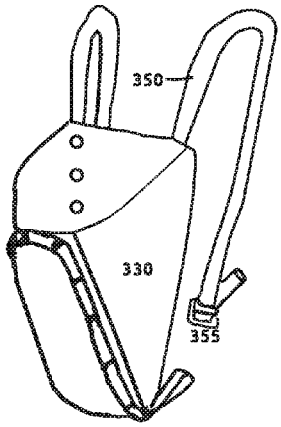
Figure 31
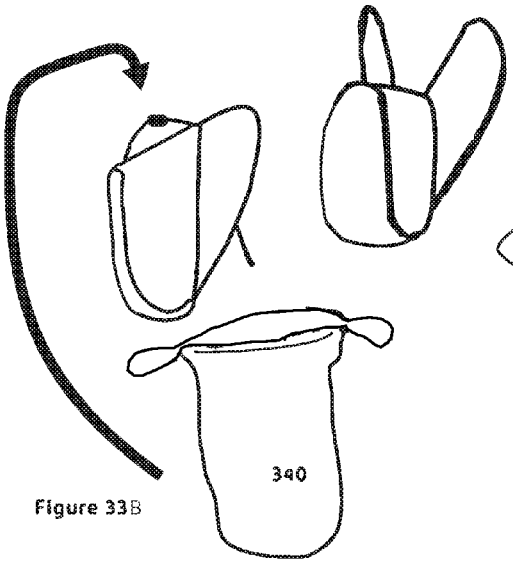
Figure 33B
Figure 33A
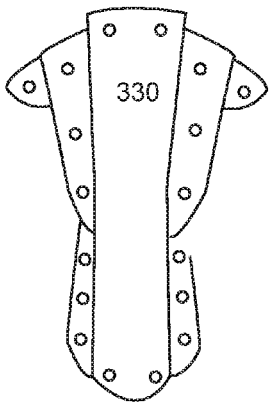
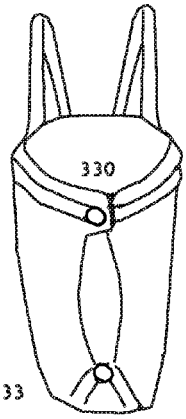
Figure 33

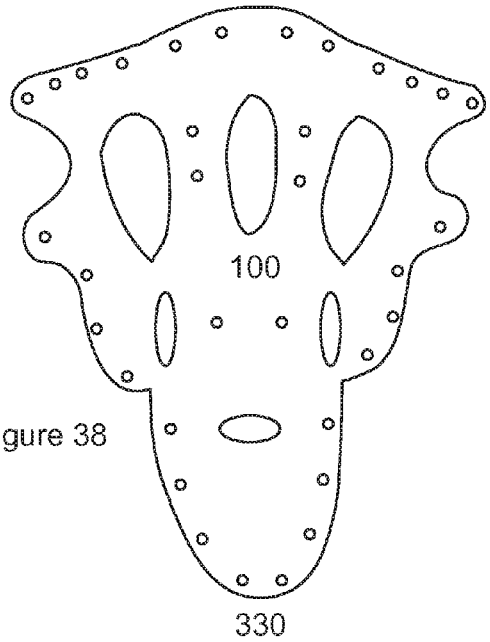
Figure 38
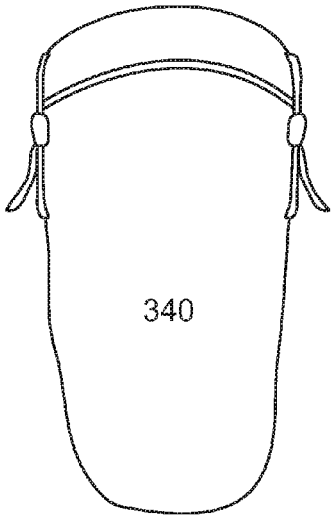
Figure 39
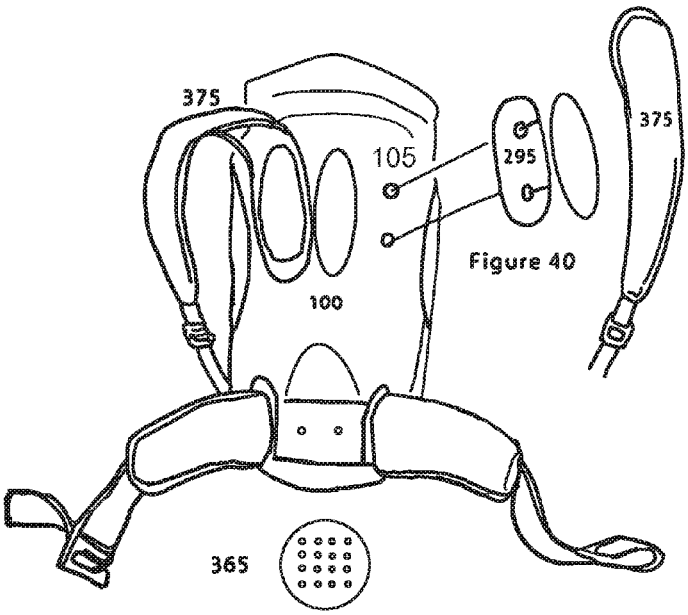
Figure 40
Figure 41
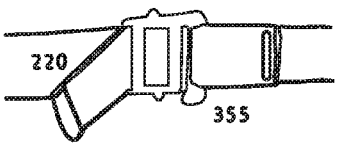

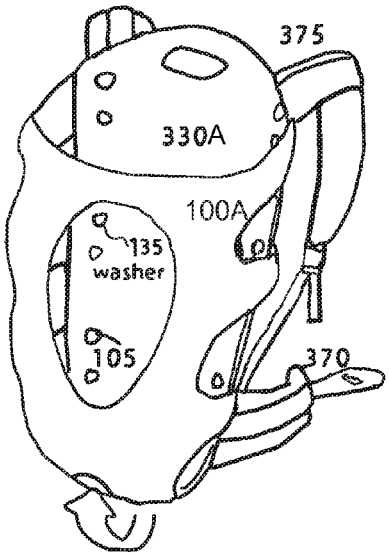
Figure 42
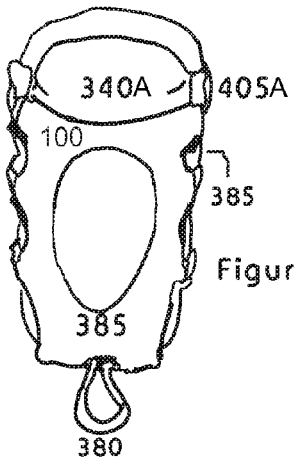
Figure 43
Figure 45
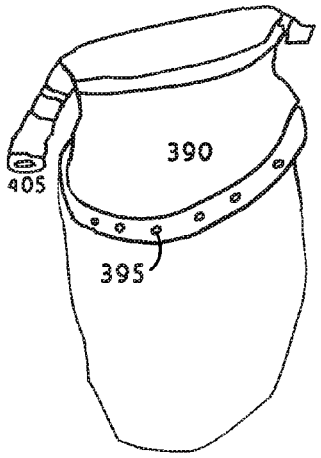
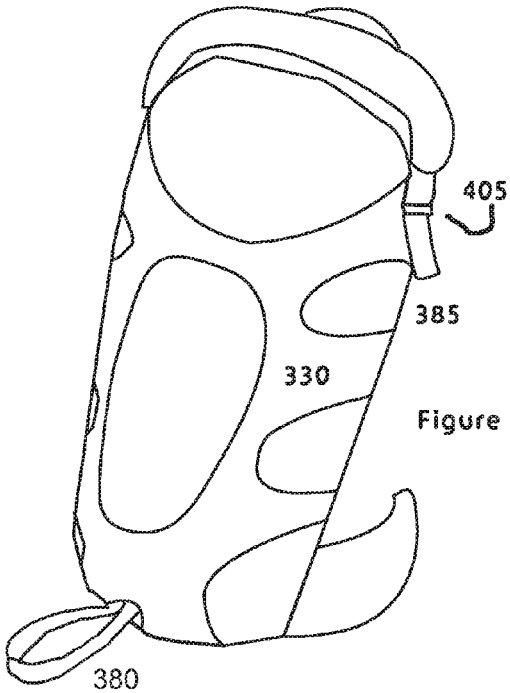
Figure 44

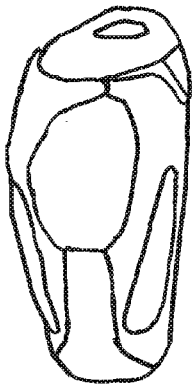
Figure 47 A
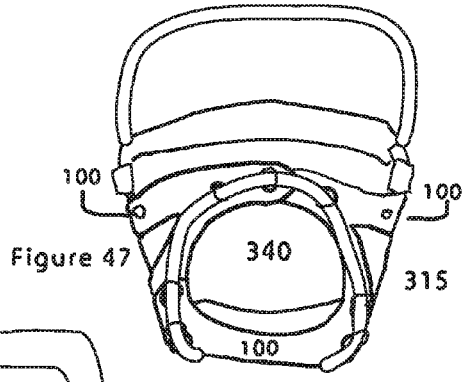
Figure 47
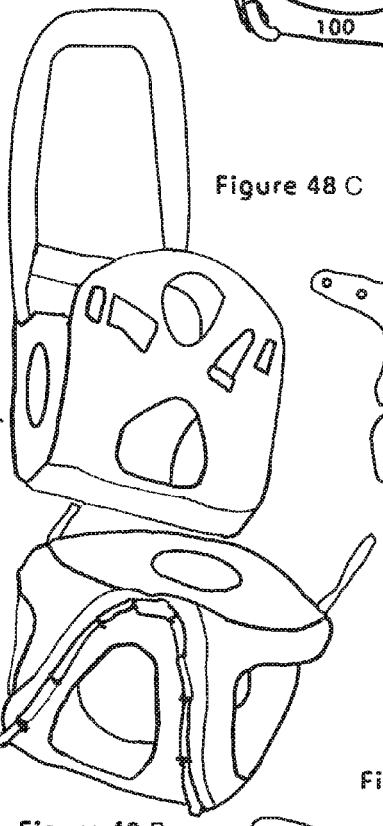
Figure 48 C
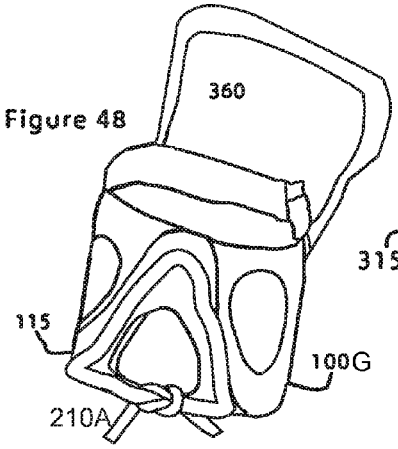
Figure 48
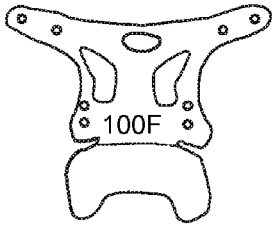
Figure 46
Figure 48 A
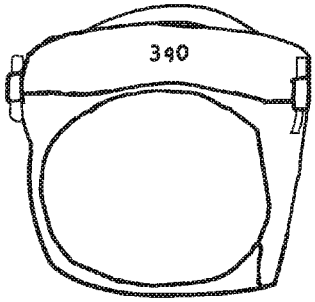
Figure 48 B
Figure 46 A
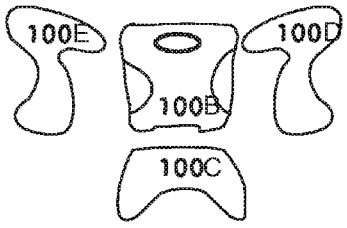

COLLAPSIBLE DURABLE OUTDOOR ADVENTURE CONTAINER

FIELD OF THE INVENTION

An apparatus and method of providing, assembling, and producing a collapsible pack, structure, shipping container, or container made from plastic, rubber, or some other sheet material, which can be formed into a variety of shapes by means of using cord, webbing, rope, wire, tubing or other flexible material, in combination with a variety of flexible fasteners, washers and O-rings to form a semi-rigid and abrasion resistant, container or structure is described.

BACKGROUND

The outdoor adventure industry continues to search for improved durability and flexibility in the material storage and transport used in small and large expeditions, such as those associated with climbs into the Himalayan Mountains in Nepal.

SUMMARY

Improved apparatus and a method of providing elements for their assembly are described. A collapsible durable outdoor adventure container includes a polymer sheet having at least two flaps and a pattern of through holes therein, wherein the through holes are positioned at prescribed locations and at intervals along a selected seam line for a frame of the container to be assembled by bending the flaps to a configuration wherein particular sets of complementarily matched through holes in the pattern are approximately coaxially aligned to form an aligned arrangement and secured in the aligned arrangement by a clamping element passing through the complementarily matched through holes causing the surfaces of the sheets adjacent such complementarily matched through holes to be held in a clamped condition by the clamping element. A strap running generally along said seam line is positionable to engage and be fixed to at least several of said clamping elements to be coupled to the polymer sheet and provide structural support to the frame and distribute a lifting force applied to the strap along the clamping elements positioned along the seam line of the polymer sheet. The frame of the container to be assembled can form the shape of a pack such that the sheeting is folded or bent so that said through holes align to provide a tubular shape closed at a bottom end. The clamping elements can be cable ties, which are individually tensioned to hold the adjacent sheet holes in alignment and in the clamped condition. The strap can be a rope held inside of a tension loop of the cable tie. The holes in the sheeting are spaced at least an inch apart and the through hole diameter is slightly larger than the width of a cable tie disposed to pass therethrough. The cable tie tension loop can pass through a washer element on the inside of the container to be assembled. The cable tie tension loop can pass through a washer element on the outside of the container to be assembled. A cable tie tension loop connector can be positioned outside the inner surface of the container to be assembled. The frame of the container to be assembled can form the shape of a pack such that the sheeting is folded or bent so that the through holes align to provide a tubular shape closed at a bottom end, and a light fabric material inner pouch is configured to be supported within and coupled to the tubular shape closed at the bottom. The frame of the container to be assembled forming the shape of a pack can be formed from at least two polymer sheet elements each having complementarily matched through holes that when aligned form a seam line along which connection points clamp adjacent surfaces of the sheet together such that the combination of two or more polymer sheets then form a sheeting assembly that is folded or bent so that said through holes align to provide a tubular shape closed at a bottom end. The at least two polymer sheet elements may have different thicknesses. A light fabric material inner pouch may be configured to be supported within and coupled to the tubular shape closed at the bottom. The polymer sheet may be a self reinforced composite. The cable ties may be rated for 50 lb continuous tensile load.

A method of supplying a collapsible durable outdoor adventure container comprising the steps of: obtaining polymer sheet material; configuring the polymer sheet material with through holes therein in at least flaps of the polymer sheet material such that when the so configured polymer sheet material is hinged or bent into a tubular arrangement, selected ones of the through holes are aligned to form a seam line, which when clamped in such tubular arrangement, form a durable outdoor adventure container; supplying clamping elements sized to pass through the through holes and bring the polymer sheet material adjacent the through holes into a clamped condition; and facilitating the use of a strap to be engaged with the clamping elements along the seam line. The through holes may be configured at least one inch, but no more than six inches between adjacent through hole along the seam line and the polymer sheet material may be a self reinforced composite.

BRIEF DESCRIPTION OF THE DRAWINGS

FIGS. 9-18 show different aspects and cross sectional shape possibilities: rectangular 225, triangular 250 and round 275.

FIGS. 26-45 show aspect and features forming one or more packs;

FIGS. 46-55 show examples of a handbag apparatus;

DETAILED DESCRIPTION

A rectangular transfer case shown in FIGS. 1 to 8. The transfer case can have a length, width and height of 62", which is currently the maximum size container airline passengers are allowed to check-in without oversize penalties. A variety of shapes and sizes of containers can be made using the construction details and materials described.

One advantage of this method of construction is that the containers or structures can easily be disassembled for ease of shipping or storage. The flexible sheet material used in the Rectangular Transfer Case is lightweight yet far more abrasion resistant and durable than woven fabrics currently used in duffle bags or soft luggage. Flexible sheet materials, that do not hydrolyze and do not have polyurethane coatings that tend to deesterfy over time, can be used to make products that are very durable and long lasting. Manufacturing is greatly simplified since the flexible sheet material can be cut with steel rule dies, waterjet cutting systems, lasers, or with scissors.

The Rectangular Transfer Case was originally designed so mountaineering expeditions can ship their gear and provisions to base camp at Mt. Everest without having to discard the empty containers somewhere in the mountains of Nepal. Currently shipping gear and provisions to Mt. Everest base camp involves air, truck or sea shipments to Katmandu and Lukla, Nepal. From Lukla either Sherpas or yaks carry the gear, for approximately 8-12 days, to Mt. Everest base camp which is located at an 18,000 foot elevation. Once the provisions have been transported to base camp, in molded plastic, fiberglass or metal containers then these hard cases are discarded since it is not cost effective to return the containers to Lukla or Katmandu and then ship the empty containers to the owner's home port.

One advantage is that numerous Rectangular Transfer Cases can be disassembled, rolled up, and placed inside one fully assembled Transfer Case and then shipped home for use at a future date. The potential cost saving is significant! There is an added environmental benefit when applying this technology to shipping goods with products made as described herein rather than using disposable or recyclable cardboard or plastic shipping containers which are recycled or discarded after use.

Rectangular Transfer Case

FIGS. 1 to 8 show the parts and procedure for assembling a collapsible and reusable rectangular transfer case.

Figure 1:
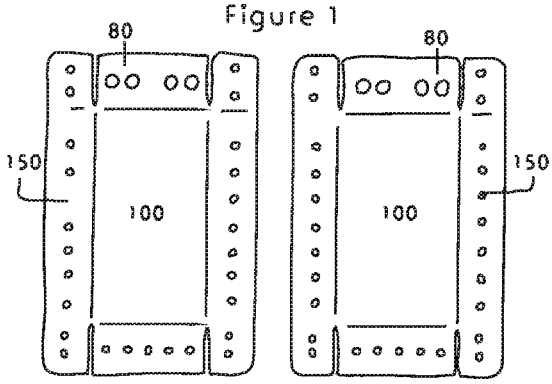

FIG. 1 shows an example of the parts needed to assemble a transfer case. There are two units of die cut flexible sheet material 100, 2 washers 135 per cable tie fastener 105, 4 O-rings 110 and a length of new or used rope 115, strapping, or other flexible material. The flexible sheet material 100 has large diameter holes 80 at one end panel (flap) to accommodate the opening and closing that takes place during packing and unpacking to accommodate the O-ring which are attached to the cable ties, in lieu of the strap or rope passing through and small diameter holes 150 where no O-rings are used. The larger fixed and slightly elastically stretchable diameter of the O-rings allow a gathering and capture of a double layer of rope or strapping used on the perimeter along the seam line of the holes. The rope acts as a perimeter flexible backbone which captures and acts as a securing element on the perimeter which contains the bulk of the container while being tied in to the container at distributed at several locations, e.g., the cable tie and through hole connection locations. The washers and cable ties are sized to prevent slippage of the cable tie securing (cam or one way motion locking) elements from passing through the hole in the center of the washer. When the securing element (cam lock) element of the cable tie is not positioned or configured to make an interference fit with the washer(s) that it is coupled through a two hole button is used as can be seen in FIGS. 3A and 4A.

Figure 2:
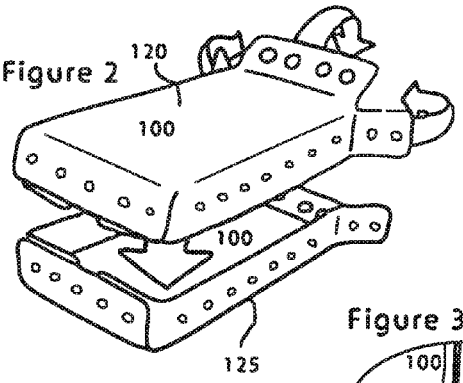
Figure 1A:
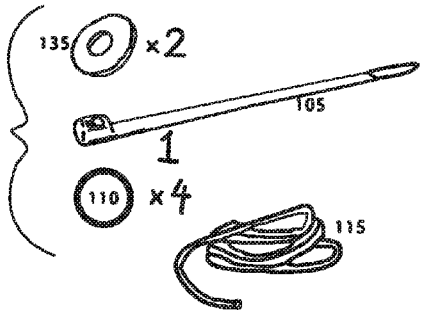

FIG. 2 shows the upper 120 and lower 125 half configurations of the flexible sheet material 100 and how they are folded to begin assembly.

Figure 3:
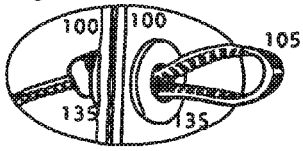
Figure 3A:
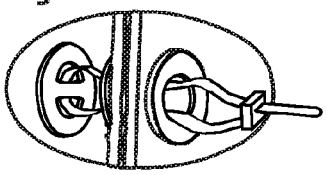

FIG. 3 shows how a cable tie 105 and two washers 135 (one on the outside and one on the inside surface) are placed through a small diameter hole in the flexible sheets 100. FIG. 3A shows the cable tie securing element on the outer surface of the container.

Figure 4:
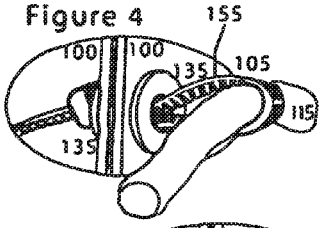
Figure 4A:
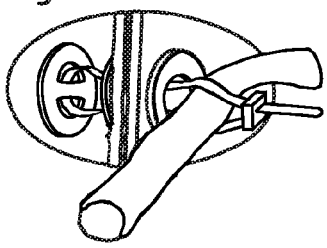

FIG. 4 shows the rope 115 threaded through the cable tie 105 loop 155. FIG. 4A shows the cable tie securing element on the outside surface of the container with the rope or strap passing through the cable tie cinching loop in preparation for being tightened.

Figure 5:
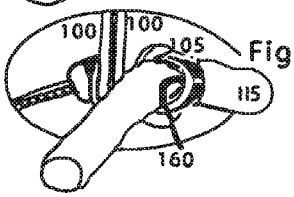

FIG. 5 shows the cable tie 105 cinched (clamped) down 160 creating a clamping force to secure the rope 115 and sheets together.

Figure 6:
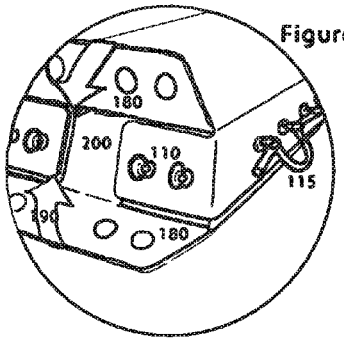

FIG. 6 shows that O-rings 110 being attached in the same manner as the rope 115 in FIG. 5. FIG. 6 also shows which direction the plastic flaps 180 are folded 190 to form an enclosed space 200.

Figure 7:
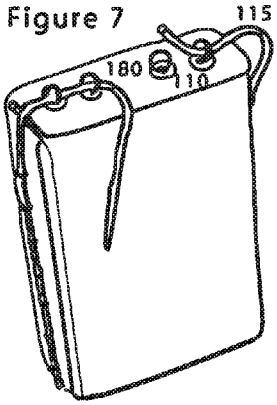

FIG. 7 shows the plastic flaps 180 are secured with the O-rings 110 positioned on the outside of the plastic flaps 180. The plastic flaps 180 are held securely in position by threading the rope 115 thru the O-rings 110.

Figure 8:
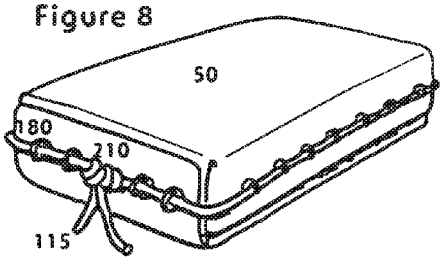
FIGS. 1 to 8 show the parts and procedure for assembling a collapsible and reusable structure such as a rectangular transfer case.

FIG. 8 shows a fully assembled and closed Transfer Case 50. The ends of the rope 115 have been tied together in a knot 210 fully securing and "locking" the plastic flaps 180 in position to keep them from accidentally opening.

FIG. 18 shows an alternate method for closing the Transfer Case 50. The rope 115 is threaded through the large diameter holes 80 in the plastic flaps 180 prior to being threaded thru the O-rings 110. The large diameter holes 80 need to be large enough to fit either rope 115 or webbing.

Triangular Case

FIG. 9 shows different cross sectional shape possibilities. Rectangular 225, triangular 250 and round 275.

FIG. 10 shows a triangular case 300.

FIG. 11 shows a knot 210 which holds the triangular case 300 closed.

FIGS. 12 and 12A show the general shape and details of the flexible sheet material 100 used for making a triangular case 300. Large diameter holes 80, rope 115, small diameter holes 150, cable ties 105, and washers 135 are shown in the diagram as well.

FIG. 13 shows the rope 115 being threaded through the cable tie 105 loops 155, at the bottom 145 of the triangular case 300, prior to cable ties 105 being cinched tight to clamp the elements together.

FIG. 14 shows the cable ties 105 on the bottom 145 of the triangular case 300 with the cable ties 105 cinched tight.

FIG. 15 shows the complete triangular case 300 in its closed and secure configuration with a knot, e.g., 210, see FIG. 18, holding the triangular case 300 closed.

FIG. 16 shows how a plurality of triangular cases 300 can stack in a space saving manner.

FIG. 17 shows that cases that have a generally rectangular 225 cross section are not as strong as cases made with a triangular 250 cross section.

Handbag

Figure 19:
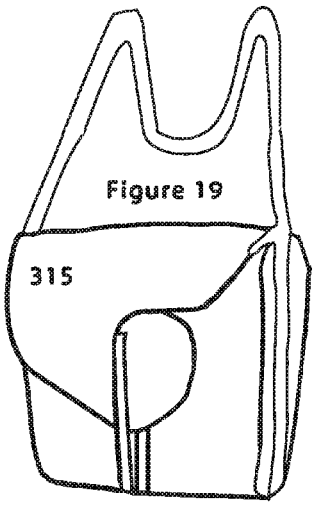
FIGS. 19-25 show aspects of a handbag 315, including a slotted 3 bar fastener.

FIG. 19 shows a handbag 315.

Figure 20:
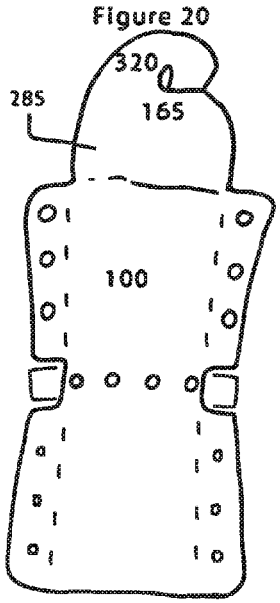

FIG. 20 shows the shape of the flexible sheet 100 which when assembled will form into a handbag 315 shown in FIG. 19. Please note the slot 165 with a slot space 320 will position the rope, strapping, or webbing 220 (FIG. 21) in a manner that holds the handbag flap 285 closed. The slot space 320 allows the rope 115 or webbing 220 to hold the handbag 315 (FIG. 19) flap 285 closed.

Figure 21:
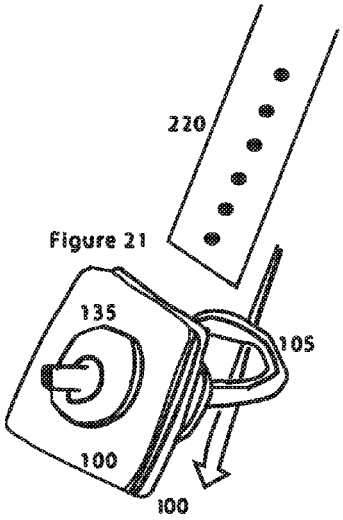

FIG. 21 shows webbing 220 can be used to assemble the flexible sheets 100 instead of a rope, wire, flexible tube or other flexible material.

Figure 22:
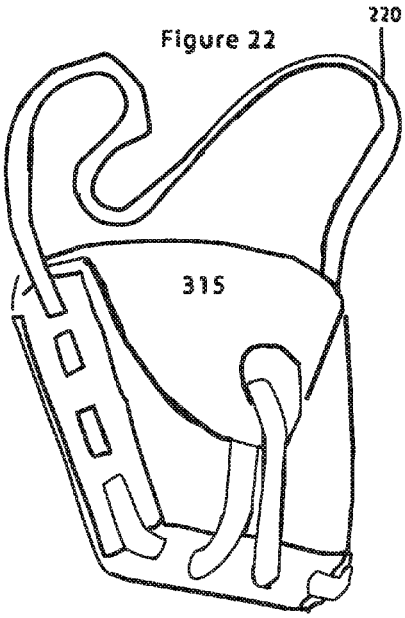

FIG. 22 shows an alternate method of assembling the handbag 315 using rope or webbing 220.

Figure 23:
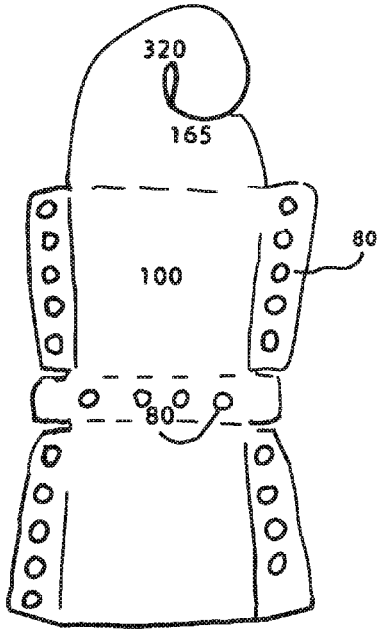

FIG. 23 shows the flexible sheet material 100 with large holes 80, a slot 165 and slot space 320.

Figure 24:
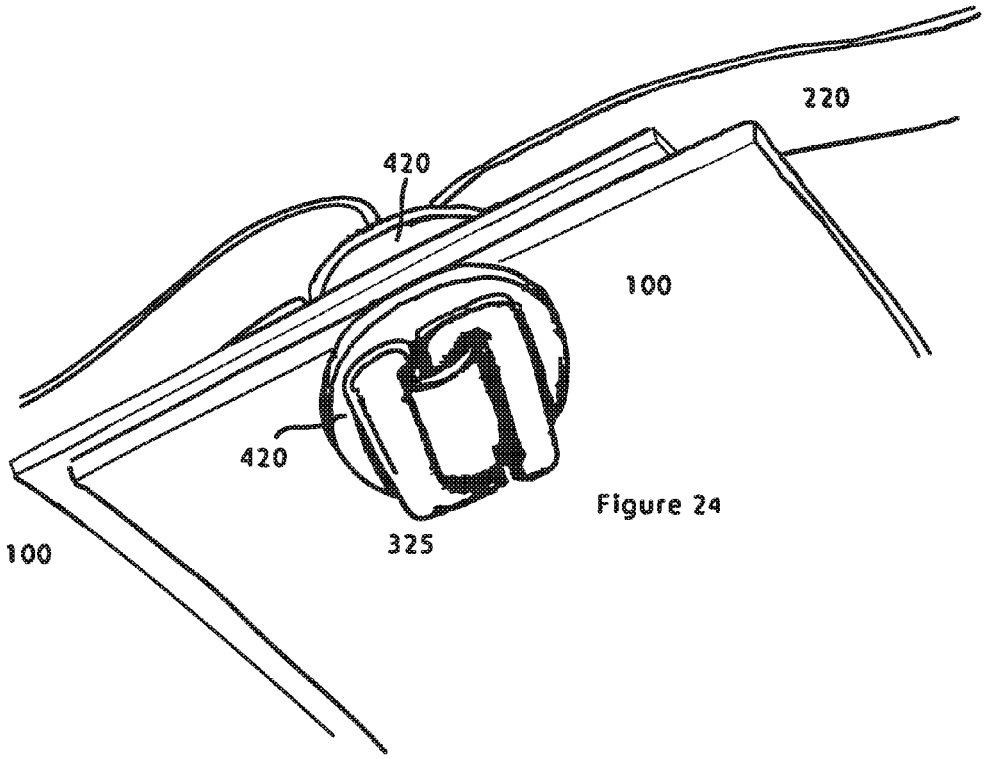
Figure 25:
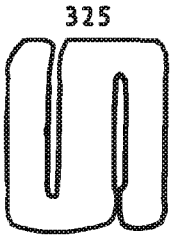

FIG. 24 shows an alternate method of assembling the flexible sheets 100 that are held together to form the handbag 315 in FIG. 22. FIG. 24 shows how the webbing 220, rectangular slot washer 420 and a slotted 3 bar fastener 325 (shown in FIG. 24 and FIG. 25) are assembled to secure the flexible sheet material 100. Please see FIG. 55 to see a detailed view a rectangular slot washer 420.

Packs

Figure 26:
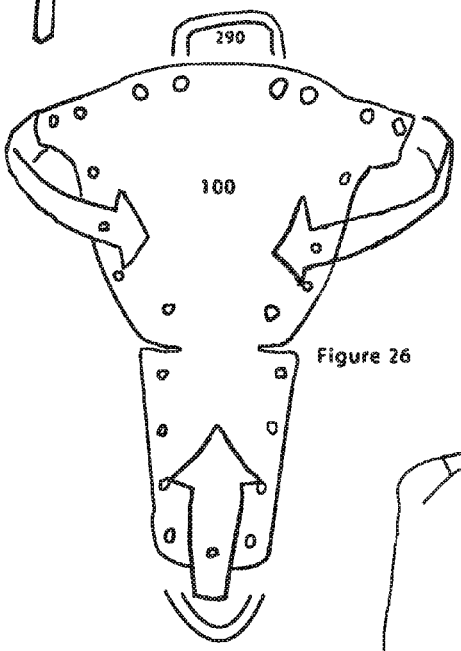

FIG. 26 shows a flexible sheet material 100 which, when folded and assembled, will form a pack. The through holes shown, can be matched up when folded or bent and particular preconfigured sizes can be can be selected by picking one of several alternative sets of matching holes. Also, bowing of the pack wall can be accomplished and facilitated by slightly different spacing of adjacent sheet elements. Like a bimetallic strip a longer element will create a permanent bend (a fixed band) in a prebowed (curved) relationship between the two adjacent elements of differing length.

Figure 28:
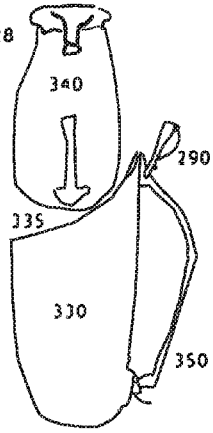
Figure 27:
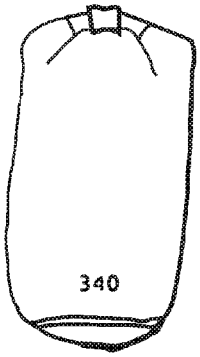

FIG. 27 shows a waterproof bag 340 which can be placed inside the pack opening 335 (FIG. 28). This is a convenient feature for backpackers since the pack 330 can be left outside the tent while the removable waterproof bag 340 can be placed inside a tent.

FIG. 28 shows the pack 330, shoulder straps 350, handle 290, pack opening 335 and removable waterproof bag 340. The pack can be assembled with webbing 220 (FIG. 29) washers and cable ties or with rope, washers and cable ties. The user can put whatever fits into the pack 330 but if the user desires a method to keep the contents dry then a removable waterproof bag 340 (FIG. 27) can be placed inside the pack opening 335. The alternate assembly method shown in FIG. 24 and FIG. 25 can be used to assemble the pack 330.

Figure 29A:
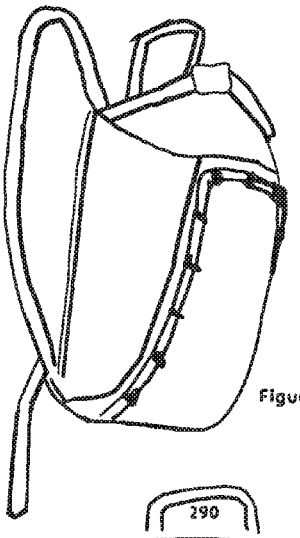
Figure 29:
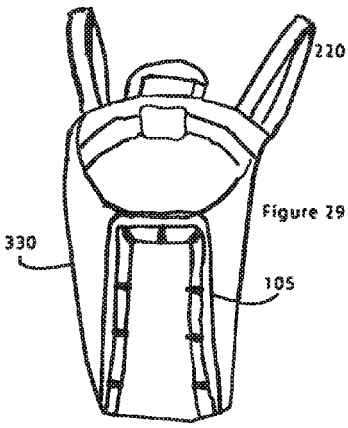

FIGS. 29 and 29A show the pack 330 assembly detail using webbing 220.

Figure 30:
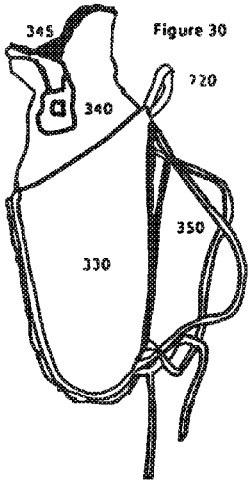

FIG. 30 shows a side view of the pack 330 with a removable waterproof bag 340. The waterproof bag 340 is in the open position 345, FIG. 30 also shows adjustable shoulder straps 350 and a webbing handle 220.

FIGS. 31, 31A, and 31B show the shoulder straps 350 can be detached from the pack 330 using a removable slider buckle 355 shown in detail in FIG. 32. The removable slider buckle 355 allows the length of the webbing to be adjusted to the users' desired comfort. The removable slider buckle 355 can be used as a quick release feature should there be a need to remove the pack 330 quickly. Removing the pack quickly would be very advantageous if someone fell through the ice on a frozen lake for example.

FIGS. 33, 33A, and 33B show an alternate pack 330 shape and usage.

Figure 34:
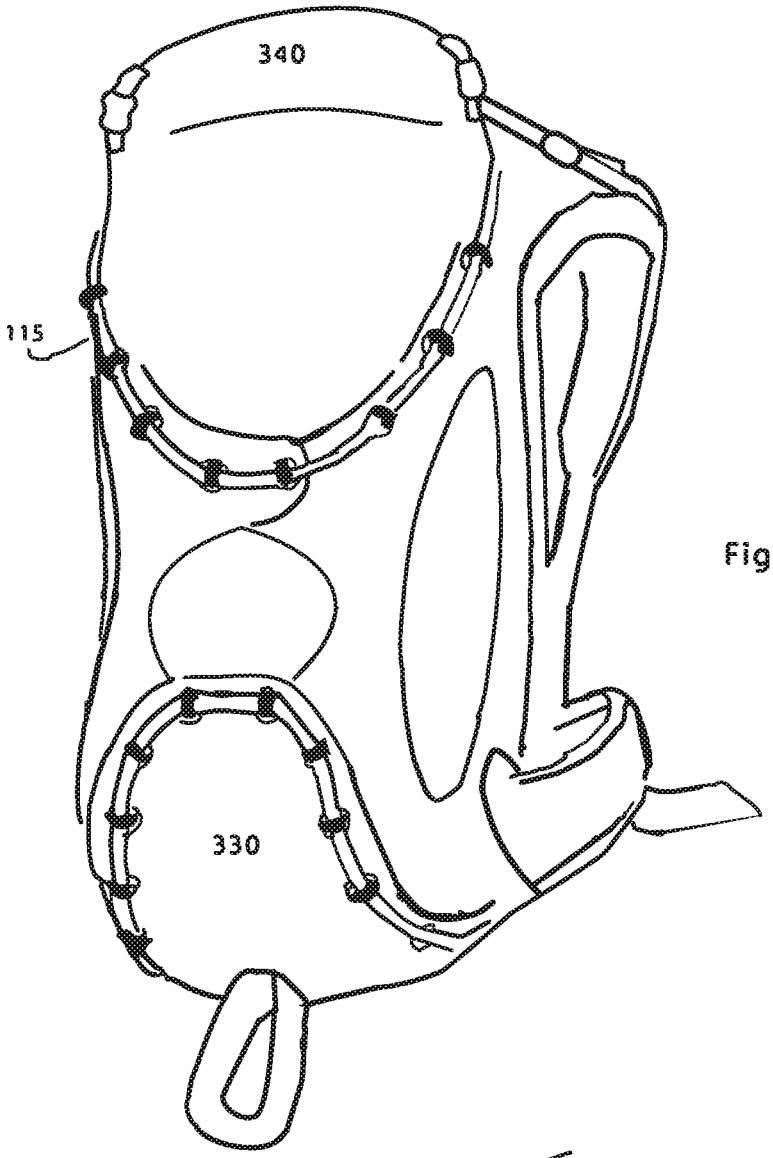

FIG. 34 shows a larger pack 330 designed to carry heavier loads with comfort. The removable waterproof bag 340 can vary in size depending on the users need.

Figure 35:
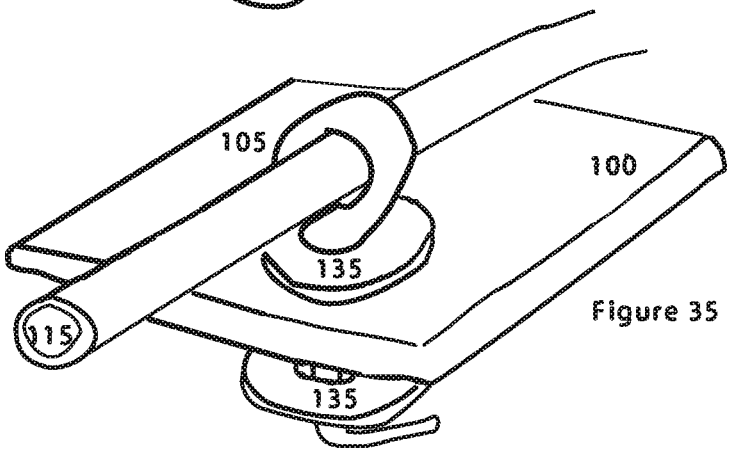

FIG. 35 shows the cable tie 105, washer 135 and rope 115 assembly method used with one layer of flexible sheet material 100. This is a desirable feature should the user need to attach items such as skis or an ice axe to the rope 115 in FIG. 34.

Figure 36:
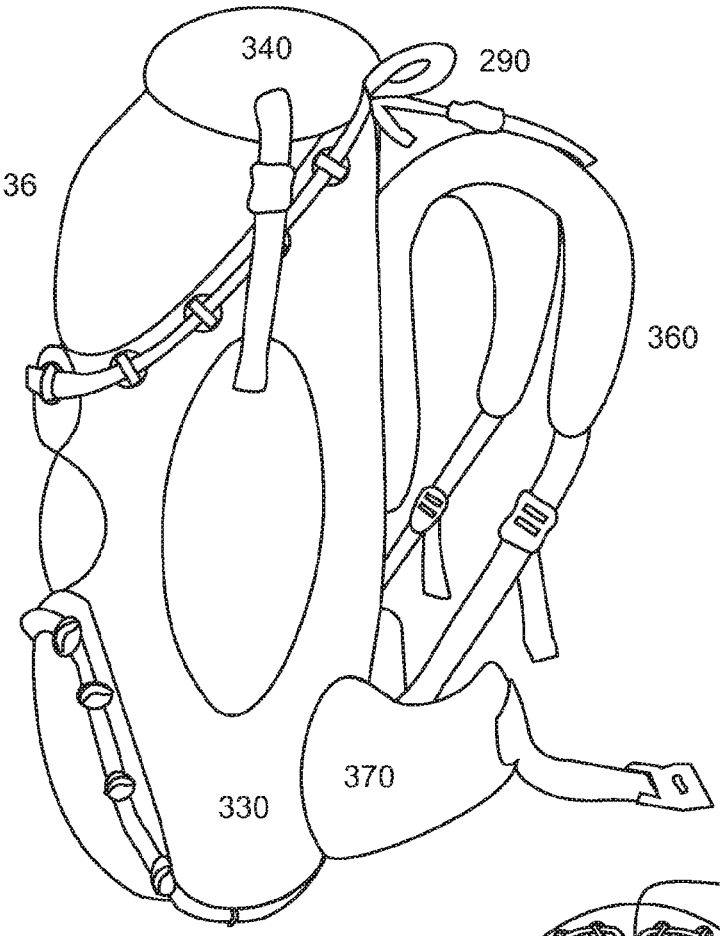

FIG. 36 shows a side view of the pack 330 with a removable waterproof bag 340 inside and having open sides, which produces the weight and stiffness of the polymer sheet (structural element—frame).

Figure 37:
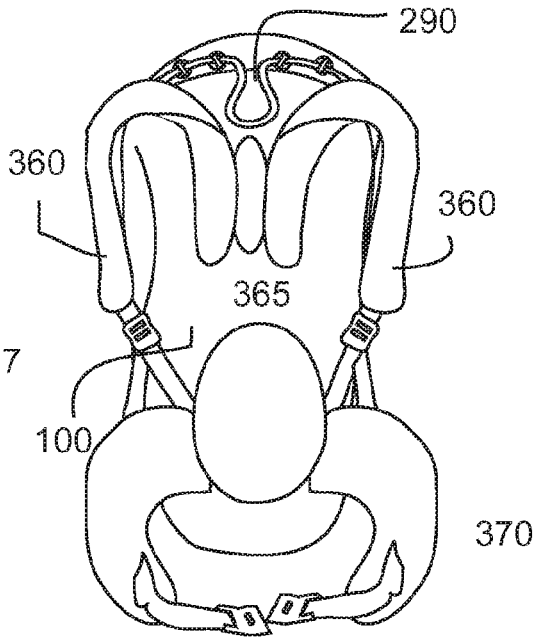

FIG. 37 shows the back panel of pack 330 (FIG. 36). The handle 290, shoulder straps 360, lumbar pad 365 and hip belt 370 unit are attached to the flexible sheet material 100 forming a more comfortable method of carrying heavier loads.

FIG. 38 shows the shape of the flexible sheet material 100 used to produce the larger pack 330 shown in FIG. 34.

FIG. 39 shows the removable waterproof bag 340 with a reinforced bottom.

FIG. 40 shows the method of attaching the shoulder harness 375, hip belt 370 assembly and lumbar pad 365 to the flexible sheet material 100 using cable ties 105 and large oval shaped washers 295 with a plurality of holes.

FIG. 41 shows a removable slider buckle 355 which is used to securely fasten the webbing 220 around the user's waist.

FIG. 42 shows an alternate method of assembling the flexible plastic sheet 100A, to form a pack 330A. In this case the cable ties 105, washers 135, rope or webbing are all attached on the same panel as the hip belt 370 and shoulder harness 375.

FIGS. 43 and 44 show pack 330A with a removable waterproof bag 340A securely fastened to pack 330A by threading the webbing closure 405A, of the removable waterproof bag 340A, through an opening 385 in the flexible sheet material 100A.

FIGS. 43 and 44 also show an ice axe loop 380 that is sewn to the removable waterproof bag 340 and is guided through an opening 385 in the flexible sheet material 100.

FIG. 45 shows a waterproof bag 390 permanently or semi-permanently attached to the flexible sheet material 100 which forms the pack 330. The attachment means can be make with nuts and bolts, cable ties, welding, radio frequency welding, carabiners, snap clips, snaps 395, quick links or any such means as to keep the waterproof bag 390 from falling out of the pack 330.

FIGS. 46 and 46A show multiple flexible sheets 100B, C, D, E, F which, when folded and assembled, will form a handbag 315 FIG. 47. FIG. 47 also shown is a removable waterproof bag 340 placed inside the multiple flexible sheets which form the handbag 315. The rope 115 or webbing in FIG. 47 is one continuous piece connected with a knot or fastened by some other means such as sewing or welding.

FIG. 48 shows a rope 115 that forms a triangle and is separate from the shoulder strap 360. The rope forms a continuous loop with a knot 21A0. A rope 115 or any number of rope 115 segments can be used to form the flexible sheet material 100G into nearly an infinite variety of shapes.

Handbag with Removable Waterproof Bag

Figure 49:
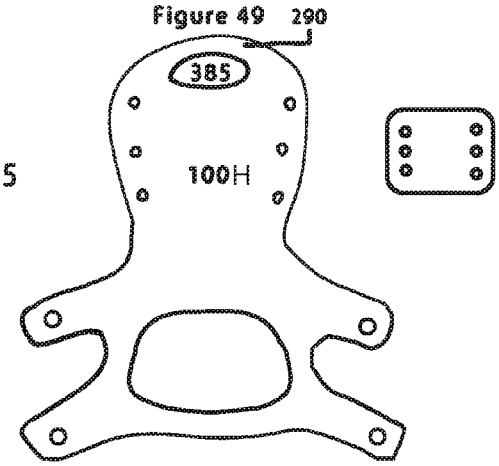

FIG. 49 shows a flexible sheet material 100H which, when folded and assembled, will form a handbag 315 with foam pad 400. FIG. 49 shows the shape of a handle 290 which is produced by cutting an opening 385, of the desired shape, in the flexible sheet material 100H.

Figure 50:
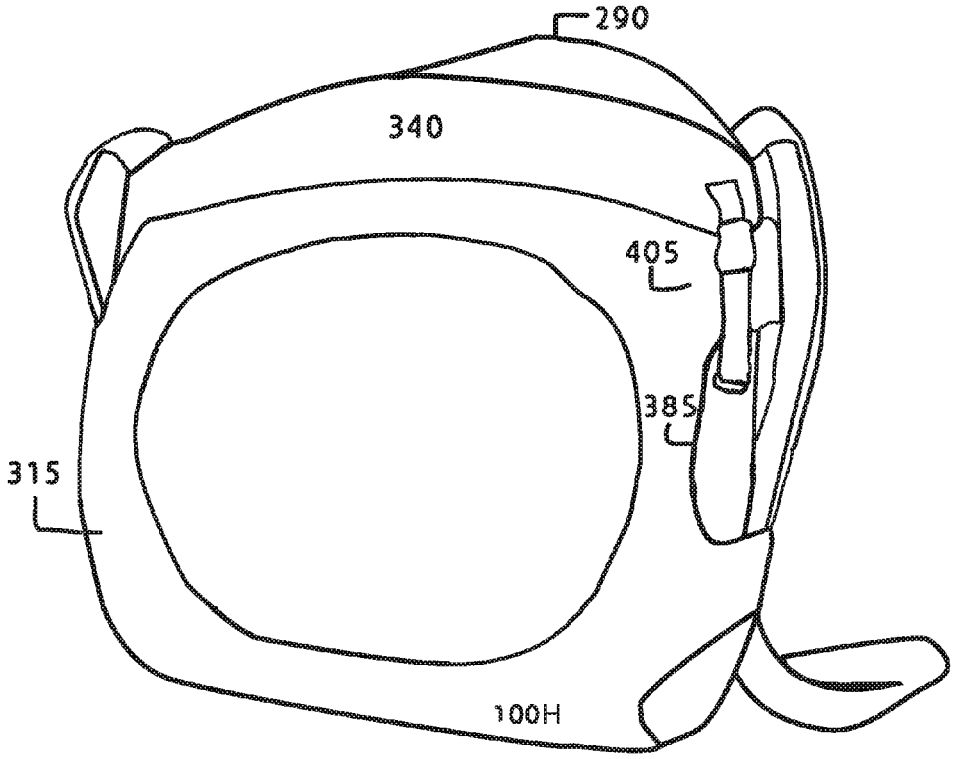

FIG. 50 shows a removable waterproof bag 340 securely fastened to the handbag 315 by threading the webbing closure 405 of the removable waterproof bag 340 through an opening 385 in the flexible sheet material 100H.

Figure 51:
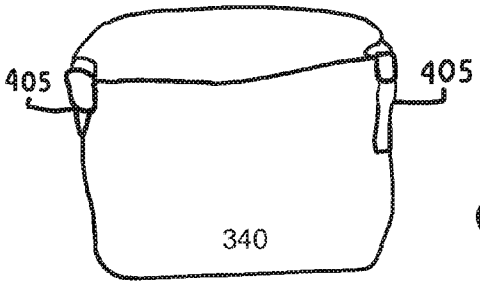
Figure 52:
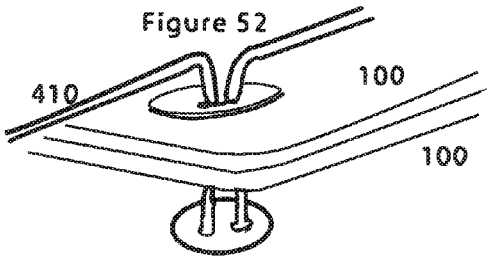
Figure 52A:
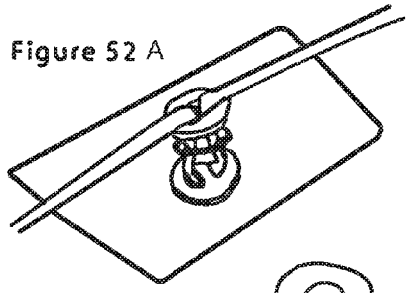
Figure 52B:
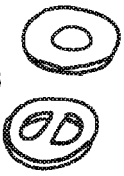

FIG. 51 shows a removable waterproof bag 340 with webbing closures 405. Alternate method of securing multiple layers of flexible sheet material without cable ties FIG. 52 shows an alternate method for securing the flexible sheet material 100 without the use of cable ties. The flexible sheets 100 can be secured using a smaller diameter cord 410 and a cord-securing clip 415. The cord-securing clip 415 can be attached to the cord 410 by attaching the cord securing clip 415 to the cord 410 by pushing the cord 410 through the slots 165. This method is quicker than if the cord-securing clip 415 only had holes with no slots because then the cord 410 would have to be threaded through each individual hole taking a significantly longer time to assemble the product.

Figure 53A:
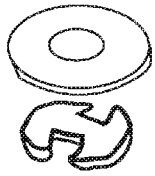
Figure 53:
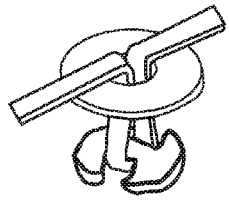
Figure 54A:
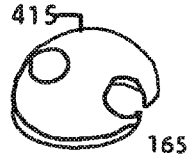
Figure 54:
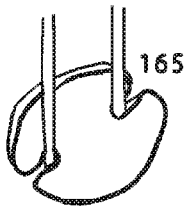
Figure 54B:
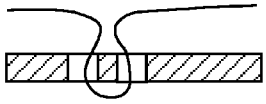
Figure 52C:
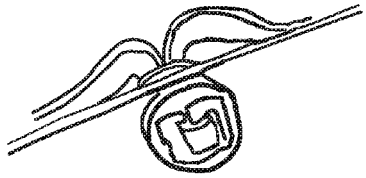

FIGS. 53 and 54 and their associated Figures show alternate cord-securing clip shapes.

Figure 55A:
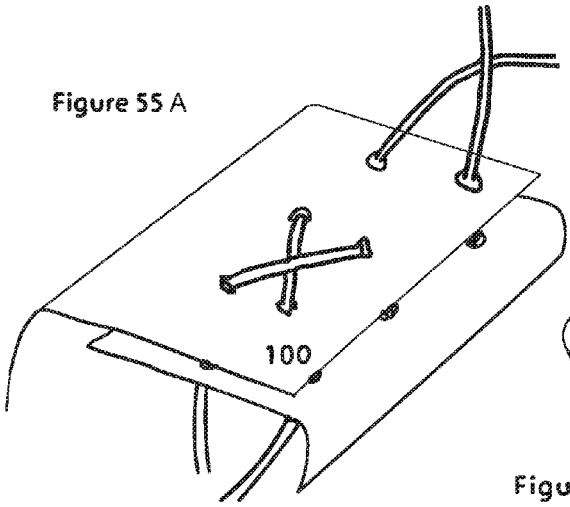
Figure 55:
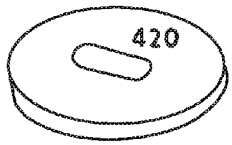

FIGS. 55 and 55A shows an example of a rectangular slot washer 420.

Figure 56:
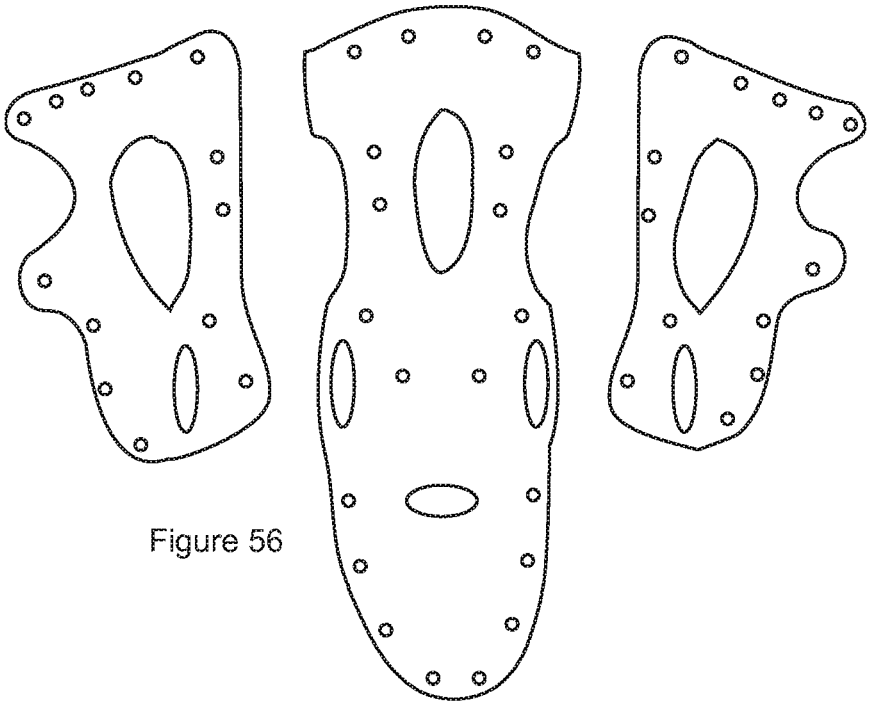
FIGS. 56-57 show an alternate embodiment of a pack shell structure configuration.
Figure 57:
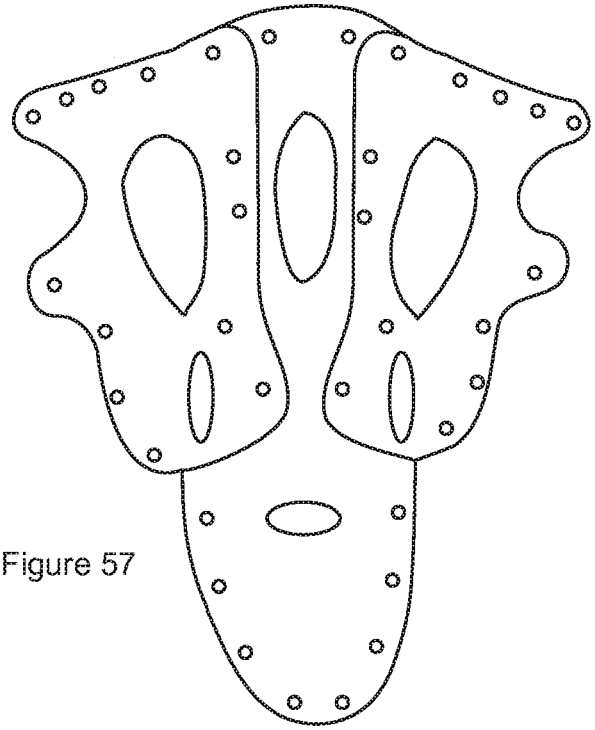

FIGS. 56 and 57 show the assembly of a pack arrangement where the flaps are a different material thickness than the midline sheet material. This arrangement allows there to be a vertical stiffness structural integrity in the support of weighted elements in the pack and in the connection to the shoulder straps and waist belt, while allowing a lightweight and easily bendable in a tight radius side panel flaps. Together the mid-palate inside flaps form a sheet assembly.

There is a special source for the sheet material. Curv® self-reinforced composites, is a new concept in thermoplastic materials that bridges the gap between commodity plastics and traditional fiber-reinforced materials. Curv® is referred to as being "self reinforced" because it comprises high-performance thermoplastic fibers in a matrix of exactly the same material. Curv® is 100% polypropylene (PP), but yields stiffness and strength values around five times those of regular PP. In addition, Curv® has a high strain to failure which in combination with good tensile strength offers tremendously high impact resistance, even at temperatures as low as −189° C.! The material also has exceptional abrasion resistance as well as tensile of strength. Application areas today are manifold: suitcases, sports equipment, automotive parts (interior & exterior), anti-ballistic products, etc. Curv® is used as a skin material in light-weight sandwich structures, usually in combination with thermal plastic core materials.

Curv® can be supplied on a roll or as a sheet in thicknesses from 0.35 to 2.9 mm, maximum width of 1360 mm and any length. The manufacturing process is very flexible and offers excellent possibilities for tailor made solutions. Curv® can be combined with materials like aluminum, glass-, aramide-, and carbon fibers, resulting in a totally new range of thermoplastic composites for a wide range of cost and performance targets.

The Curve Propex is one type of material used for the backpacks. It comes in black only and in numerous thicknesses (0.35 mm, 0.66 mm, 1.00 mm, 1.34 mm, 1.68 mm, 2.02 mm, 2.36 mm, 2.70 mm and 2.95 mm. The white material, used to make transfer cases and transfer case is an extruded sheet material and is a commonly available "High Density Polyethylene". A 0.030" thick material is used for most transfer case applications. Various thicknesses of Propex or High Density Polyethylene can be used or combined to create stiffer or more flexible areas which is especially desirable for packs. The manufacturer is Propex Fabrics GmbH.

Special cable ties that are used with rounded on the edges which minimizes abrasion. The cable ties are made of UV resistant nylon 6.6 with stainless steel keeper. Operating temperatures of −40 degrees F. to 185 degrees F. The manufacturer is Thomas & Betts.

The washers are die cut out of the sheet materials described above or we use stainless steel washers purchased from McMaster-Carr are used.

The rope or webbing is rated for climbing. The pack can be disassembled and the webbing or rope can be used as a belay device. The John Howard Company provides the webbing. Sterling Ropes provides the braided rope.

The mechanism by which the waterproof bag is sealed is that the opening of the bag is held closed and then rolled. The rolled fabric is held in place by plastic side release buckles. UTX and National Molding, Corp. make such items.

Dry Bag Closure provide a water resistant or proof material which when it does not have an air tight seal such as when using a zip-lock plastic element interlocking groove type seal, is well known in the art to have a sealing end which is rolled up (wound tightly on itself in a tight roll) and then a belt or strap attached to half of the opening circumference is locked by a buckle in a loop, to thereby resist unraveling (or unwinding).

The waterproof bag is a polyether coated nylon fabric with a 2,000 mm to 20,000 mm hydrostatic head waterproof rating. The bags are assembled either with RF welding the seams or by sewing and then hot taping them. Shapes vary but most waterproof bags are square, rectangular (most common) or cylindrical (also common). Sizes are infinite and only limited by what a few people can lift by hand.

Preventing the waterproof bag from being ruptured by the washers around which the tie wraps are secured on the inside surface of the box, bag, and pack structures.

The terminal ends of the cable ties can be configured to be on the outside of the pack so there are no abrasion points on the inside (see FIGS. 3A, 4A). The washers and flat portion of the cable ties do not affect the waterproof bag fabric.

In the pack configuration, there are straps through the holes in the sheet material, which allow the bag to have lots of slack before the limit of motion of the inner bag from the surrounding flexible sheet material frame is reached. Generally the inner bag will be held in the pocket shape of the pack frame/sheeting by gravity.

Attachment of an ice axe to the ice axe loop extending from the bottom section of the inner bag and through a corresponding opening in the outer structural wall will significantly limit the upward motion of the waterproof bag. Holes or slots can be punched into the sheet material in a manner that the webbing on the waterproof bags will lock the bag into position.

The flexible sheet material needs to hold its shape when the pack is fully loaded. Packs are used to carry weight comfortably. This is done (by the pack) which transfers the weight and being carried to users shoulders and waist. The flexible sheet material needs to be stiff enough to be able to transfer the weight from the bag to the shoulders and hip belt, yet not so flexible that it deforms under its own weight when not loaded. Comfort is increased if the pack can flex with the body's movement. The flexible sheet material will also act as an exoskeleton for the inner waterproof bag, so that the inner bag may be made of lighter weight fabrics, this will in turn allow for less total weight.

The flexible sheet material will have a higher resistance to most types of abrasion, more than any woven fabric of a comparable weight. In addition the flexible sheet material holds a higher water resistance than most fabrics especially after prolonged UV exposure.

Cable ties are needed since they hold the webbing or rope in place. This allows the user to use the webbing or rope as tie out anchors where you can attach things to the pack. Handles can be formed by adding extra rope or webbing between cable ties. This would not be possible without cable ties. The cable ties used have a minimum breaking strength of 50 lbs. In contrast, hand stitching or sewing films and sheet composites creates weak spots where the needle holes are. This system has the advantage that there is a certain distance (generally not less than one inch and not greater than six inches) between holes so the integrity and strength of the fabric are maintained. Sewing creates a long line of small holes than allows the film or composite to crack along the seam line.

In contrast to using cable ties when the rope or strapping was threaded using the threading method (as shown in the figures), the trouble was that the rope or belt materials stretch and do not hold the plastic sheets in close tight contact alignment because the only thing holding the plastic in place is the tension experienced in the slack threaded rope. When a user laces something, like a shoe, only the knots at the end hold things in place and the user is counting on the tension in the slack portion of the rope keeping everything aligned. With the cable ties you lock the webbing and plastic in position which allows you to create curved structures that will keep their shape.

The rope or webbing is not ornamental. The structure can be made without a rope or webbing. Rivets or bolts could be used to hold the plastic sheet material together. The trouble is that then there is no tie loop to work with, unless they are specially added to the bolts or rivets. With the current configuration of using a perimeter rope along a seam line of connecting and aligned through holes in the polymer sheet material overall support and stability and a second outside supported element (the rope) helps maintain the container integrity. If a user trips and falls and the plastic cracks, then in the present configuration the rope will still hold the pack together. The rope/webbing system also allows you to quickly disassemble the pack for transport (using reusable-releasable cable ties) and later assemble the pack for use. Imagine having 20 packs that need to be put in a Cessna 210 (bush plane) for transport. Rivets will not allow you to easily disassemble the pack. Nuts and bolts would work but then adding tie outs to them is problematic and using any one of the anchors might create a weak spot. The rope or webbing distributes any stresses when used to anchor things to the pack. The rope/webbing system allows a greater variety of anchor points with witch to attach things to.\

The embodiment described and shown in the drawings are examples of many ways which collapsible durable outdoor adventure containers. The descriptions are not limiting, and provide examples of structures and methods as are understood by persons skilled in the art from the language of the claims appended hereto.

The invention claimed is:

1. A collapsible durable outdoor adventure container comprising:

a polymer sheet having at least two flaps and a pattern of through holes therein, wherein said through holes are positioned at prescribed locations and at intervals along a selected seam line for a frame of the container to be assembled by bending said flaps to a configuration wherein particular sets of complementarily matched through holes in said pattern are approximately coaxially aligned to form an aligned arrangement and secured in the aligned arrangement by a clamping element passing through each of the complementarily matched through holes causing the surfaces of the sheet flaps adjacent such complementarily matched through holes to be held in a clamped condition by each corresponding said clamping element;

wherein a strap running generally along said selected seam line is positionable to engage and be fixed to at least several of each corresponding said clamping element to be coupled to said polymer sheet and provide structural support to the frame and distribute a lifting force applied to the strap along each corresponding said clamping element positioned along the selected seam line of the polymer sheet; wherein the clamping element comprises two or more individual cable ties each having a keeper, wherein each cable tie is individually tensioned to hold the corresponding through holes in alignment and in said clamped condition;

wherein said strap is positioned to be held inside of a tension loop of said cable tie.

2. The collapsible durable outdoor adventure container as in claim 1, wherein the frame of the container to be assembled forms the shape of a pack such that the sheet is folded or bent so that said through holes align to provide a tubular shape closed at a bottom end.

3. The collapsible durable outdoor adventure container as in claim 2, wherein said strap is a rope held inside of a tension loop of said cable tie.

4. The collapsible durable outdoor adventure container as in claim 1, wherein said holes in said sheet flaps are spaced at least an inch apart and said through hole diameter is slightly larger than a width of a cable tie disposed to pass therethrough.

5. The collapsible durable outdoor adventure container as in claim 4, wherein said cable tie tension loop passes through a washer element on the inside of the container to be assembled.

6. The collapsible durable outdoor adventure container as in claim 4, wherein said cable tie tension loop passes through a washer element on the outside of the container to be assembled.

7. The collapsible durable outdoor adventure container as in claim 5, wherein said cable tie tension loop passes through a washer element on the outside of the container to be assembled.

8. The collapsible durable outdoor adventure container as in claim 3, wherein said cable tie tension loop connector containing said keeper is positioned outside an inner surface of the container to be assembled.

9. The collapsible durable outdoor adventure container as in claim 4, wherein said cable tie tension loop passes through a washer element on the outside of the container to be assembled.

10. The collapsible durable outdoor adventure container as in claim 1, wherein the frame of the container to be assembled forms the shape of a pack such that the sheet flaps are folded or bent so that said through holes align to provide a tubular shape closed at a bottom end, and a light fabric material inner pouch is configured to be supported within and coupled to said tubular shape closed at the bottom.

11. The collapsible durable outdoor adventure container as in claim 1, wherein the frame of the container to be assembled forming the shape of a pack is formed from at least two polymer sheet elements each having complementarily matched through holes that when aligned form a seam line along which connection points clamp adjacent surfaces of the sheet elements together such that the combination of two or more polymer sheets then form a sheet assembly that is folded or bent so that said through holes align to provide a tubular shape closed at a bottom end.

12. The collapsible durable outdoor adventure container as in claim 11, wherein the at least two polymer sheet elements have different thicknesses.

13. The collapsible durable outdoor adventure container as in claim 11, further comprising a light fabric material inner pouch configured to be supported within and coupled to said tubular shape closed at the bottom.

14. The collapsible durable outdoor adventure container as in claim 12, further comprising a light fabric material inner pouch configured to be supported within and coupled to said tubular shape closed at the bottom.

15. The collapsible durable outdoor adventure container as in claim 1, wherein said polymer sheet is a self reinforced composite.

16. The collapsible durable outdoor adventure container as in claim 1, wherein each said cable tie is rated for at least a 50 lb. continuous tensile load.

* * * * *